US006490556B2

(12) United States Patent
Graumann et al.

(10) Patent No.: US 6,490,556 B2
(45) **Date of Patent: *Dec. 3, 2002**

(54) AUDIO CLASSIFIER FOR HALF DUPLEX COMMUNICATION

(75) Inventors: David L. Graumann, Beaverton, OR (US); Claudia M. Henry, Portland, OR (US)

(73) Assignee: Intel Corporation, Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/323,179

(22) Filed: May 28, 1999

(65) Prior Publication Data

US 2002/0165718 A1 Nov. 7, 2002

(51) Int. Cl.[7] ..... G10L 11/02

(52) U.S. Cl. ..... 704/233; 704/215

(58) Field of Search ..... 704/233, 215, 704/248, 253

(56) References Cited

U.S. PATENT DOCUMENTS

| | | | | | |
|---|---|---|---|---|---|
| 4,001,505 | A | * | 1/1977 | Araseki et al. | 704/246 |
| 4,004,101 | A | * | 1/1977 | Vaillant | 704/212 |
| 4,277,645 | A | * | 7/1981 | May, Jr. | 704/233 |
| 4,849,972 | A | * | 7/1989 | Hackett et al. | 370/465 |
| 5,159,638 | A | * | 10/1992 | Naito et al. | 704/213 |
| 5,548,638 | A | * | 8/1996 | Yamaguchi et al. | 379/202.01 |
| 5,884,255 | A | * | 3/1999 | Cox | 704/233 |

* cited by examiner

*Primary Examiner*—Marsha D. Banks-Harold
*Assistant Examiner*—Donald L. Storm
(74) *Attorney, Agent, or Firm*—Schwegman, Lundberg, Woessner & Kluth, P.A.

(57) ABSTRACT

A half duplex switching device includes an input connection for receiving an input audio signal, and classification module coupled to the input connection. The classification module provides an output which indicates a classification of the input signal based upon a density of the input audio signal, an energy level of the input audio signal, and classification data provided with the input audio signal. A switching device is coupled to the classification module and determines if the received input audio signal contains speech signals based upon the output of the classification module. The communication receiving device can be used in both communication systems which provide continuous speech signals, and communication systems which remove silence and only provide speech signals.

24 Claims, 4 Drawing Sheets

AUDIO CLASSIFIER FOR HALF DUPLEX COMMUNICATION

TECHNICAL FIELD OF THE INVENTION

The present invention relates generally to audio communication and in particular the present invention relates to capturing audio data transmissions.

BACKGROUND OF THE INVENTION

In many digital communication systems, audio captured at a remote location is delivered to a local location in either a continuous stream of data, or in bursts of data packets. When a continuous stream is delivered, it contains all audio captured at the remote location. When bursts of data packets are delivered, the packets typically contain only speech or music deemed important by the remote endpoint. Thus, the packets containing silence are typically not delivered. These audio packets can arrive at the local location at unpredictable intervals, or may even be dropped, due to unreliable network behavior or audio system behavior caused by heavy loading. These unpredictable delivery patterns make it extremely difficult to design Half-Duplex Open Audio functionality into such systems.

Traditional half-duplex hands-free audio systems assume that a continuous stream of remote audio is delivered, and that the contents of remote audio can be analyzed using a voice activity detector (VAD) to make meaningful speech/noise classifications on the received audio data. Because remote locations adhering to new protocols attempt to conserve network bandwidth by dropping rather than transmitting unnecessary audio packets, the assumption of continuous data does not hold true on today's digital systems. Thus, the local half-duplex communication algorithms do not get a chance to analyze the content of all the audio captured at the remote location. Half-duplex communication algorithms operating under these conditions either rely on remote speech/noise classifications when determining whether the remote audio should be played at the local site or, play all audio received, under the assumption that all packets received from the remote site contain meaningful audio.

For the reasons stated above, and for other reasons stated below which will become apparent to those skilled in the art upon reading and understanding the present specification, there is a need in the art for a communication system which allows half-duplex communication in systems receiving either continuous data or packet-based data.

SUMMARY OF THE INVENTION

In one embodiment, a communication receiving device comprising a density measurement device is coupled to receive an input audio signal and provide an output indicating if the received input audio signal contains speech signals based upon a density of the input audio signal. A voice activity detector is coupled to receive the input audio signal and provide an output indicating if the received input audio signal contains speech signals based upon energy levels of the input audio signal. A parser device is coupled to receive the input audio signal and provide an output indicating if the received input audio signal contains speech signals based upon data provided with the input audio signal. A classifier device is coupled to the density measurement device, voice activity detector, and parser device for classifying the received input audio signal.

In another embodiment, a half duplex switching device comprising an input connection for receiving an input audio signal, and classification module are coupled to the input connection. The classification module provides an output which indicates a classification of the input signal based upon a density of the input signal, an energy level of the input signal, and classification data provided with the input audio signal. A switching device is coupled to the classification module. The switching device determines if the received input audio signal contains speech signals based upon the output of the classification module.

DETAILED DESCRIPTION OF THE INVENTION

In the following detailed description of the preferred embodiments, reference is made to the accompanying drawings which form a part hereof, and in which is shown by way of illustration specific preferred embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present inventions. The following detailed description is, therefore, not to be taken in a limiting sense, and the scope of the present invention is defined only by the appended claims.

As stated above, communication systems can transmit audio data as either continuous packets or as packets of audio which have silence removed (bandwidth-conservation). Additionally communication links can transmit all packets received, or may inadvertently lose some packets. Traditionally, half duplex (HDX) schemes that expect a continuous audio stream do not function properly if they receive audio data discontinuously, in bursts. Thus, newer half-duplex communication systems that rely on a remote location classification do not function properly with the old data streaming systems. This incompatibility is because the remote speech/noise classifications are absent. Further in systems that assume that all packets received from the remote site should be played, playback will always be active, preventing locally captured audio from ever being sent to the remote site. Additionally, instabilities in the network which cause unreliable packet delivery can lead to even more classification problems. This is true for both traditional and bandwidth-conservation systems.

The present invention takes into account not only the contents of individual audio packets, but also the delivery timing patterns for the packets and any remote classification information available.

Figure 1:
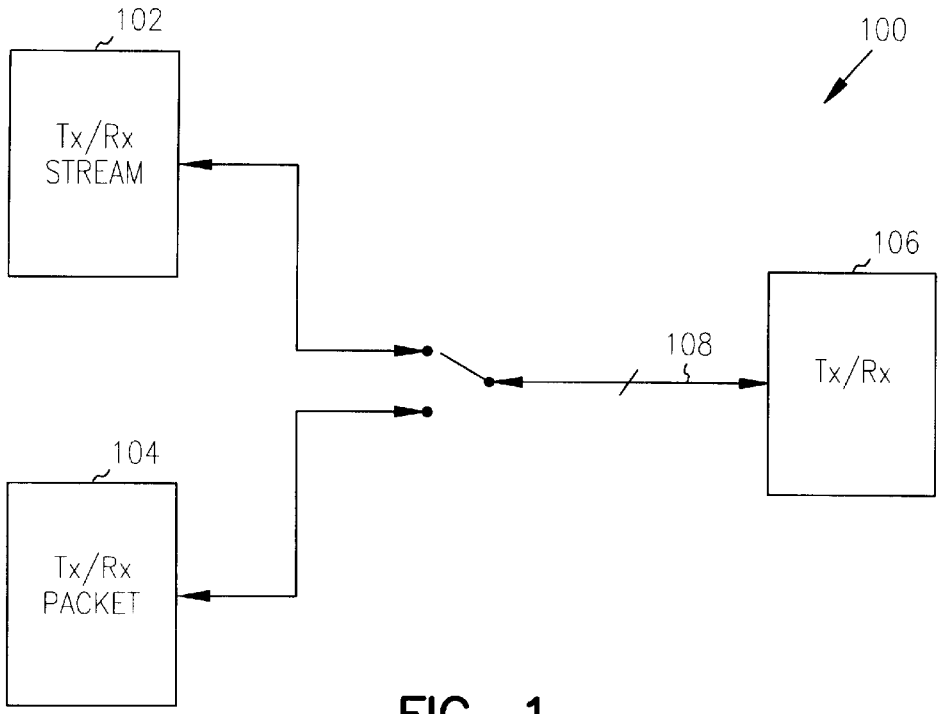
FIG. 1 is a communication system of one embodiment of the present invention.

Referring to FIG. 1, one embodiment of the present invention is illustrated. The communication system 100 includes a local transmitter/receiver (Tx/Rx) 106 which transmits audio data over a communication line(s) 108. One remote transmitter/receiver is also coupled to the communication line(s). The remote transmitter/receiver can provide either a continuous stream of data 102, or asynchronous data packets 104. It will be appreciated that only one of the remote transmitter/receiver devices illustrated is coupled to the system at once. Both remote transmitter/receiver devices have been illustrated to explain that different types of remote transmitter/receiver devices could be used with the present invention. The transmitter/receiver units can be provided in an audio only system, or in an audio/video system, such as a video conference system.

Figure 2:
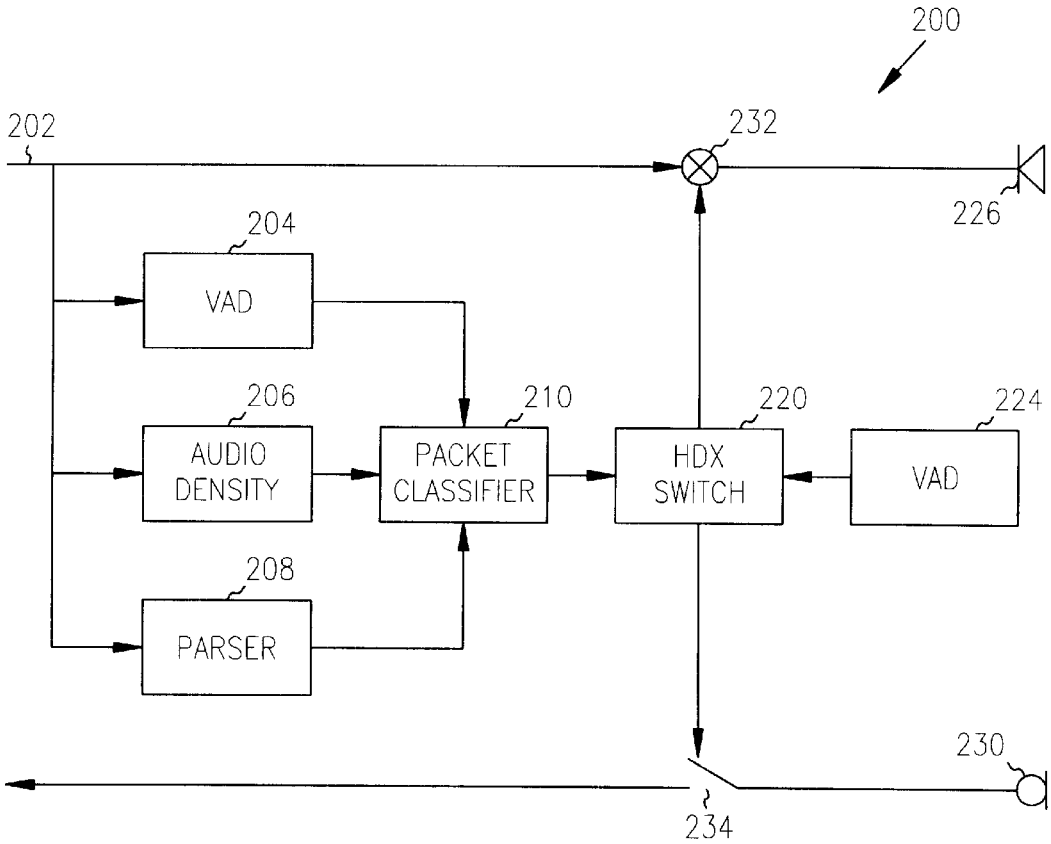
FIG. 2 illustrates one embodiment of a local transmitter/receiver unit according to the present invention.

FIG. 2 illustrates one embodiment of the local transmitter/receiver unit 200. The invention comprises a packet classification parser 208, audio density measurement unit 206, a voice activity detector 204, and a packet classifier 210. A microphone 230 and speaker 226 are also included for providing local audio and playing received audio signals, respectively. A half-duplex switching device 220 controls communication over the communication line using either amplifier 232 and/or switch 234. A local voice activity detector 224 can also be provided, so that out-going signals are transmitted during a time in which the transmitter/receiver is not receiving voice signals.

The enhanced voice activity detector (VAD) 204 operates on bursty data streams as well as continuous data streams. During sparse audio delivery, when the audio density drops, the voice activity detector begins looking only for voiced speech packets. The term 'audio density' as used herein refers to audio arrival distribution. At these times, a noise floor is assumed to be approximately the minimum energy level received during speech segments. Thus, most packets will be classified as speech during periods of sparse delivery. As the audio density rises, the voice activity detector begins to look for long segments of noise and/or silence. When more noise or silence is detected in the stream, the voice activity detector determines which segments are meaningful to play and which should be dropped. The enhanced voice activity detector provides each packet's speech/noise classification to the packet classifier. The VAD in one embodiment performs both classification methods simultaneously and the packet classifier 210 determines which classification to use.

The dual, or enhanced, VAD is a hybrid of a sophisticated activity detector capable of detecting speech signals within a continuous stream of audio, and containing an energy parser that can make coarse discrimination between noise signals and non-noise signals. The VAD provides two classifications based upon both a 'sophisticated' method and a 'simple' method. The sophisticated activity detector can comprise any one of a generic class of voice or music activity detectors, and the method described herein is robust enough for speech applications. The sophisticated method uses a long-term energy level, while the simple method uses a minimum energy level. The decision to act on either of these classifications is the responsibility of the packet classifier, described below. The terms 'simple' and 'minimum' energy are used interchangeably herein.

It will be appreciated after studying the present disclosure that the classification methods can be replaced with more sophisticated classifications depending on the applications and system resources. Two audio energy moving averages (short-term, and long-term) are created by the VAD using the following equation, $$\text{Energy} = \frac{1}{N}\sum_{n=0}^{N-1}(x(k-n))^2$$

Where x( ) is a digital sample of audio data, k is the current time index, and N is the audio sample count determined by N=Window Duration (in seconds) multiplied by an Audio Sampling rate (in samples per second).

The first moving average computed is a short-term energy average which uses a window duration of about 0.030 seconds. The second moving average computed is a long-term energy average which uses a window duration of about 4 seconds. These two moving averages are similar in magnitude when the variations in the audio signal are small and deviate from one another when the variance of the signal energy increases. If the ratio of the short-term energy divided by the long-term energy is greater than about 2, then speech signals are considered present. This is representative of a 6 dB gain in the short-term energy over a floating background energy. This method is referred to herein as ST/LT (short-term/long-term) or sophisticated classification.

Figure 3:
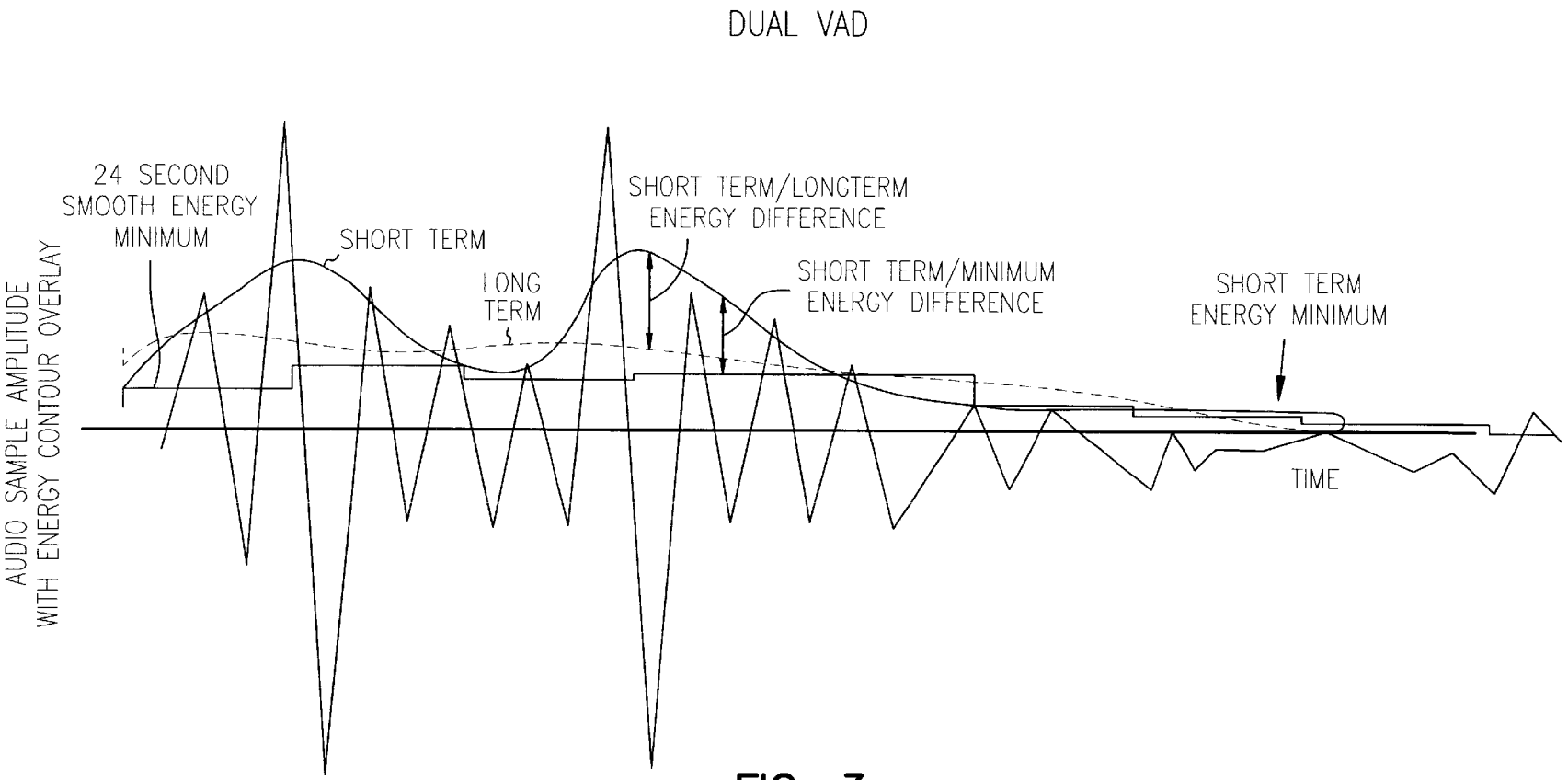
FIG. 3 provides an illustration of an example audio sample energy contour.

ST/LT provides an instantaneous classification of the received signals. Once this ratio drops below the value 2, the classifier declares the signal frames as non-speech. In this way it provides a very 'raw' classification of audio packets. More sophisticated methods can be added to this approach starting with zero crossings analysis and moving up in complexity to pitch detection and unvoiced speech discrimination methods. These additions can reduce classification errors during continuous audio reception, but are not sufficient when lost packets are occurring due to transport or remote endpoint characteristics. It will be appreciated that the present invention is not limited to the exact time and ratio values described. Using the present disclosure, other values for ST/LT can be developed without departing from the present invention. FIG. 3 provides an illustration of three example audio energy contours superimposed on a sample audio signal. The short term energy contour and the long term energy contour are illustrated.

Speech is classified by the VAD through a comparison of the short term energy to a short term energy minimum tracked over an approximately 24-second period. A minimum observed short-term energy is latched once per second, and the minimum value is maintained for the entire 24 second sliding window. Outliers, or extraneous data points, are discarded by a single pole smoothing filter. The process of acquiring an energy minimum is as follows:

1SecLatched Minimum=1SecLatched Minimum, where 1SecLatched Minimum≦Short Term Energy 1SecLatched Minimum=Short Term Energy, where 1SecLatched Minimum>Short Term Energy, and 24SecSmoothed Minimum=24SecSmoothed Minimum * β+1SecLatched Minimum * (1−β)

Where β is chosen as a function of the short-term window duration. In one embodiment this variable is approximately 0.98. This process maintains a smoothed minimum energy over the last 24 seconds of audio.

If the current short-term energy divided by the short-term minimum is greater than about 2.8 (9 dB) then it is determined that the packet contains speech. Otherwise, the packet is considered non-speech. This method is referred to herein as a Minimum Energy classification, or 'simple classifier' classification. Like ST/LT, the simple classifier provides an instantaneous decision without any onset and decay considerations.

Reference is now made to the packet classification parser 208 of FIG. 2. In general, the packet classification parser extracts a remote speech/noise classification from each packet, if it is present. The packet classification parser also provides an output which indicates that the received packet is either SPEECH, SILENCE, or UNKNOWN (if no classification information exists in the packet).

The packet classification parser simply tallies the occurrences of Silent Packet information being provided from the remote endpoint. This is a somewhat minor task and is broken out herein as a separate process for modularity. Often, but not always, remote endpoints provide an indication that they have detected silence and will be stopping the transmission of audio until they detect the onset of new speech. This indication is usually contained in external packet header information. The parser tallies the number of times this information indicates Silence over a predetermined time, for example the last 12 seconds, excluding the current 0.500 seconds. This is referred to as a Silence Detection Sum (SD Sum) and is used by the packet classifier in conjunction with audio density characteristics to better determine the true classification, as described below.

Also, for each connection with a remote endpoint, any single observation of a Silence Classification is latched to assist in the general operation of the Audio Classifier. If the remote endpoint has transmitted a silence indication during the current connection then this indicator is set to TRUE. Otherwise, the indicator remains at a FALSE indication.

The audio density module 206 provides a measurement of received audio density, as explained in greater detail below. The audio density, or the amount of audio data received in a given period of time, is measured by monitoring when each audio packet is received and incorporating the receipt of the packet into a numerical value which indicates a level of continuousness of streaming. For example, a higher density figure indicates that streaming is more continuous, and a lower figure indicates that the streaming is more bursty. Both short-term and long-term density measurements can be taken, as explained above.

The short-term density measurement uses a short time window in which the ratio of the duration of audio received relative to the total window time is calculated as a percentage. The duration of audio received is equivalent to the playback time span of the audio packet. The resultant figure indicates the duty cycle of audio during the short window. The long-term density is measured in the same fashion, except that the fixed window is on the order of 10 times longer than the short window. The combination of these two values determines the audio density. The short-term density describes the distribution of delivery, while the long-term density describes the overall average density. Patterns of density behavior can be examined to determine whether any burstiness in the audio streaming may be caused by network problems, or by the remote transmitter/receiver dropping non-speech audio packets. Both the voice activity detector and the packet classifier use the audio density measurements to perform their tasks.

Figure 4:
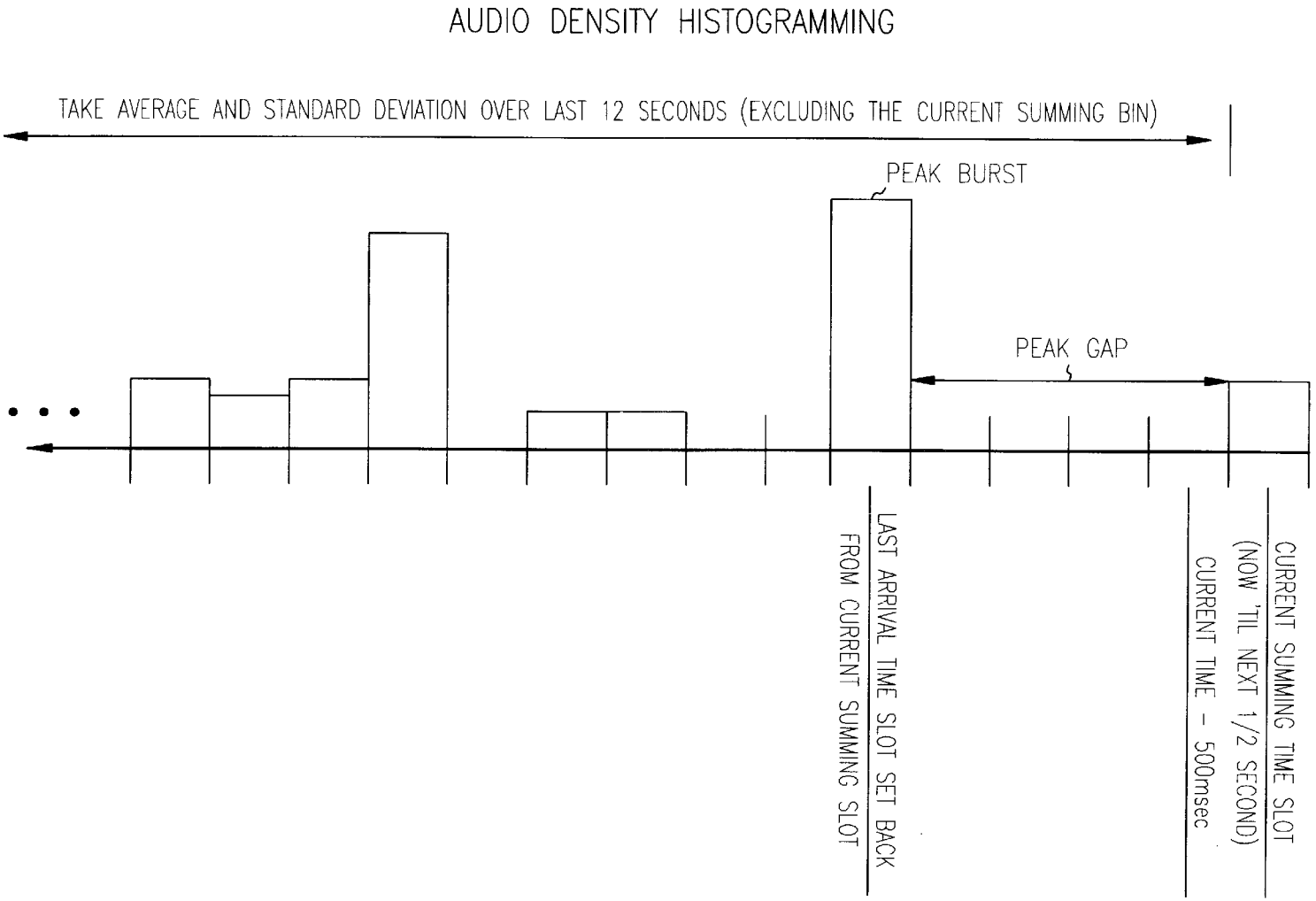
FIG. 4 illustrates one embodiment of a histogram of audio arrival.

The audio density measurement provides a rough indication of the arrival characteristics of the audio packets. A histogram is provided for the audio playback 'duration' of all packets arriving over the past 12.5 seconds. FIG. 4 illustrates one embodiment of a histogram. The histogram is established by each packet's time-of-arrivals (TOA) into the system. The time resolution is about 0.500 seconds, thus creating 25 bins of 0.500 second duration. Packets arriving into the system are 'stamped' with a local system time (this is their TOA). Their audio playback 'duration' is summed into the appropriate bin in the histogram.

It is important to note that the histogram is a sliding 12.5 seconds window. New TOA bins are created on the right-hand side of the histogram as the system time progresses from 'now' into 'infinity', while bins are dropped on the left-hand side of the histogram as they become 'older' than 'now minus 12.5 seconds'. Because this is being presented as an event-driven process and not a schedule-driven process, new packet arrivals do not occur at regular time intervals. They arrive into the system based on particular characteristics of the remote endpoint and communications link. This behavior makes the sliding window 'jump' and 'pause' as packets arrive at random TOAs.

One example arises when a packet arrives after 13 seconds of no packet arrivals. In this case a new 0.500 second bin for the new packet is 'created' and the bins for the previous 12 seconds of time are set to zero. All audio histograms older than the 12.5 seconds are thus dropped. The other extreme occurs when a packet arrives in less than 0.500 seconds after the last packet. In this case the previous packet TOA has already been used to create a new 0.500 second bin. The previous packets 'duration' has already been added to that bin. When the new packet arrives (for example 0.100 seconds later) its audio duration time is added to the previously created bin. In this way all 0.500 seconds audio bursts are summed into one bin, then the histogram moves to the next bin. This is segmented on 0.500 seconds boundaries of the system timer. This means that in the above example, if the second packet arrives 0.100 seconds after the previous packet, but the system timer has moved from 2.450 seconds to 2.550 seconds, then the second packet's playback duration is summed into a new bin.

After creation of the sliding window histogram, the audio density measurement updates its running statistics by interrogating (but not interpreting) the past 12 seconds of audio arrival. It excludes the current 0.500 seconds because this data is still being acquired, and passes measured values to the packet classifier for interpretation. The measurements are:

$$\text{Density} = \frac{1}{D}\sum_{n=0}^{N-1} Bin(n),$$

where N is number of bins, D is the total bin duration (12 sec).

$$\text{Standard Deviation} = \sqrt{\frac{1}{N}\sum_{n=0}^{N-1} (Bin(n) - (Avg(Bin(n)))^2},$$

where N is the number of bins (24), Bin(n) is the individual bin summation.

MaxGap=Maximum consecutive bins with zero sums * Bin Duration (0.500 seconds).

MaxBin=Maximum bin sum plus greatest adjacent bin sum.

SumGap=Number of gaps exceeding 0.250 seconds in the last 12 seconds.

Figure 5:
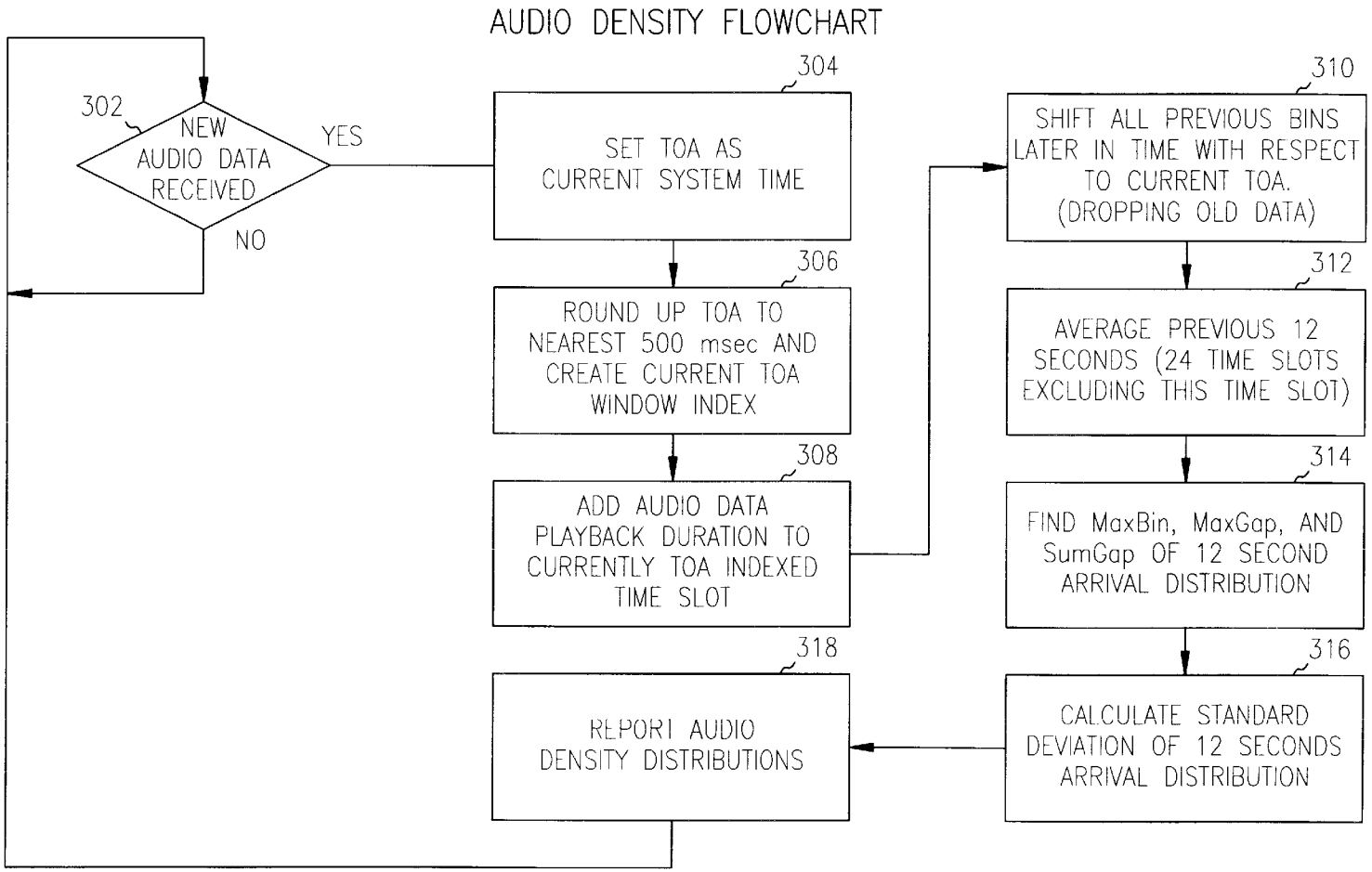
FIG. 5 is a flow chart of one embodiment of an audio density operation.

A flow chart 300 of the audio density operation is illustrated in FIG. 5. After new data has been received at 302, the TOA is set as the current system time at 304. The TOA is rounded to the nearest 500 ms and the current TOA window index is set at 306. Audio data playback duration is added to the current TOA indexed time slot at 308. All bins are shifted later in time at 310. The previous 12 second window is averaged at 312, and the Max Bin, Max Gap, and Sum Gap of the 12-second window are calculated at 314. The standard deviation is then calculated at 316. Finally, the audio density is determined at 318 (sum of audio duration/window duration).

Referring again to FIG. 2, the packet classifier 210 determines whether a current audio packet is eligible for playback. This decision is made by taking into account whatever information is provided by the packet classification parser, the audio density measurement, and the enhanced voice activity detector. For example, if the audio stream is very bursty, all packets received are considered eligible for playback, unless the packet classification parser indicates that the incoming audio is noise or silence rather than speech. On the other hand, if the audio stream is continuous, then the voice activity detector's speech/noise decision is used to determine eligibility. Many other scenarios are possible, with the information from all sources accounted for, to make the best possible playback eligibility decision.

The audio classifier considers all the information at its disposal before making a final packet classification of the packet. It does not attempt to make HDX transition decisions, just raw classification decisions. Information channels made available to the classifier by the audio density, VAD and the packet classification parser are:

Audio Density (percentage);

Audio arrival distribution (Standard Deviation);

Sum of the audio silence gaps exceeding 250 ms (Sum Gap);

Max Silence gap (MaxGap);

Max Burst plus max adjacent (MaxBin);

Sum of Silence Detection classifications from remote endpoint (SD Sum);

Latched Silence Detection observed from this remote endpoint (TRUE/FALSE);

Sophisticated VAD Speech/non-Speech Classification (Speech/Non-Speech);

Simple VAD Speech/non-Speech Classification (Speech/Non-Speech);

The use of this information is mostly determined empirically with the basic rule for making a Speech/Non-Speech decision centering on the Audio Density and Silent Detection inputs.

In one embodiment, the audio classifier operates under the following fundamental Rules:

1. If the Audio Density is >0.9 and the latched Silence Detection is FALSE, then the remote endpoint is a Full Duplex endpoint and the sophisticated VAD classification is used outright.
2. If the Audio Density is ≦0.9 and the Latched Silence Detection is TRUE, then the packet's classification defaults to speech.
3. If the Audio Density is <0.6 and Latched Silence Detection is FALSE, then the simple classification is used.

There are many other combinations that can result from the available information channels. These combinations are outlined in Table 1 and are used to remove ambiguities when the Audio Density range is between 0.9 and 0.6. The standard deviation (STD) over the past 12 seconds provides a confidence factor for the decision making process. For example, if the STD is large, then the stream is arriving in bursts. If the STD is low, then the audio is arriving steadily or not at all. This value, in conjunction with the Audio Density, suggests the stability of the stream.

The mere fact that packets arrived into the system is by itself an indication that they should be played on the loudspeakers. For lack of all other information, each packet classification will default to Speech. This is referred to herein as an Arrival classification and is used if there are no other means to classify the audio content.

The remaining input information is meaningful for detecting outliers. An example of an outlier is as follows: If the SD Sum or SumGap are large then there are too many fluctuations for this audio to represent meaningful speech. In a specific case, if the arriving packets each contain 0.120 seconds of audio data and SDSum over the past 12 seconds registers over 16 (i.e. SD packet arrivals average one every 0.750 seconds), then the remote endpoint is improperly transmitting audio. In this situation the simple classifier is used to sort the valid and invalid signals. Other possibilities are captured in Table 1.

TABLE 1

| Density | STD | Latched SD | Outlier Override | Classification |
|---|---|---|---|---|
| >.9 | x | x | | Sophisticated |
| 0.6≦, ≦0.9 | <1.5 | FALSE | | Simple |
| 0.6≦, ≦0.9 | <1.5 | TRUE | | Arrival |
| 0.6≦, ≦0.9 | >1.5 | FALSE | | Simple |
| 0.6≦, ≦0.9 | >1.5 | TRUE | | Simple |
| <.6 | x | FALSE | | Simple |
| <.6 | x | TRUE | | Arrival |
| <.9 | x | x | SD Sum > 16 | Simple |
| <.9 | x | x | SumGap > 16 | Simple |
| x | x | x | Max Bin > 5 sec. | Arrival |
| x | x | x | Initialization | Arrival |

Initialization of the Density, STD, and other statistics must be achieved before the values are considered for classifying packets. This is especially true when interacting with remote endpoints that are running Silence Detection algorithms. There will be large time slots where no audio will be received. During this time the audio density will drop, the STD will go to zero, and the SD Sum and SumGap will shrink. To properly reinitialize, the classifier will wait for 12 seconds for every method to establish meaningful data. During this time all packets will be declared as speech.

The final classification is shared with the HDX switching algorithm executed by the HDX switcher 220. This switcher can be any of a general type suitable for managing an HDX audio stream for echo suppression or HDX audio streaming. The classifications described above are raw, and considerations beyond this instantaneous classification may be needed for useful audio switching.

For example, after a classification transitions between speech and silence has occurred, the classifier should not turn off the audio until approximately 80–120 ms later. Likewise, once the signal has been classified as Speech for longer than 120 ms, it should remain (hang) in this classification for at least 80–180 ms. That is, during conversations there are often pauses contained in speech which should continue to be classified as speech. The half duplex device, therefore, is used to provide flexibility in the receiving device.

CONCLUSION

A half duplex switching device has been described which includes an input connection for receiving an input audio signal, and classification module coupled to the input connection. The classification module provides an output which indicates a classification of the input signal based upon a density of the input audio signal, an energy level of the input audio signal, and classification data provided with the input audio signal. A switching device has also been described which is coupled to the classification module. The switching device determines if the received input audio signal contains speech signals based upon the output of the classification module. As such, the communication receiving device can be used in both communication systems which provide continuous speech signals, and communication systems which remove silence and only provide speech signals. The modules of the present invention can be implemented in either hardware, software, or a combination of both. As such, the VAD, audio density module, packet classifier, parser, and HDX switch can be implemented in software executed by a processor. Further, the processor can be operating in response to instructions provided on a computer readable medium, such as a magnetic or optical disc.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. Therefore, it is manifestly intended that this invention be limited only by the claims and the equivalents thereof.

What is claimed is:

1. A communication receiving device comprising:

a density measurement device coupled to receive an input audio signal and provide an output indicating if the received input audio signal contains speech signals based upon a density of the input audio signal, wherein the density measurement device is further to sum an audio playback duration of the input audio signal into a bin in a histogram and shift all previous bins later in time with respect to a time of arrival of the input audio signal;

a voice activity detector coupled to receive the input audio signal and provide an output indicating if the received input audio signal contains speech signals based upon energy levels of the input audio signal;

a parser device coupled to receive the input audio signal and provide an output indicating if the received input audio signal contains speech signals based upon data provided with the input audio signal; and a classifier device coupled to the density measurement device, voice activity detector, and parser device for classifying the received input audio signal, wherein the classifier device is to use in the classifying an audio density percentage.

2. The communication receiving device of claim 1 wherein the voice activity detector monitors a short-term moving average of the energy levels of the input audio signal, and a long-term moving average of the energy levels of the input audio signal.

3. The communication receiving device of claim 2 wherein the voice activity detector also monitors a short-term minimum energy of the input audio signal.

4. The communication receiving device of claim 1 wherein the voice activity detector monitors a short-term moving average of the energy levels of the input audio signal, and a short-term minimum energy level.

5. The communication receiving device of claim 1 wherein the density measurement device maintains the histogram of the density of the received input audio signal over a predetermined time period.

6. The communication receiving device of claim 5 wherein the density measurement device provides outputs indicating a signal density of the input audio signal, a standard deviation of the signal density, and an indication of an amount of time in which the input audio signal has a zero density.

7. The communication receiving device of claim 1 further comprising a switching device coupled to the classifier device, the switching device determines if the received input audio signal contains speech signals.

8. A half duplex switching device comprising:

an input connection for receiving an input audio signal;

a density measurement device coupled to the input connection to provide an output indicating if the received input audio signal contains speech signals based upon a density of the input audio signal, wherein the density measurement device is further to sum an audio playback duration of the input audio signal into a bin in a histogram and shift all previous bins later in time with respect to a time of arrival of the input audio signal;

classification module coupled to the input connection, the classification module provides an output which indicates a classification of the input signal based upon a density percentage of the input signal, an energy level of the input signal, and classification data provided with the input audio signal; and a switching device coupled to the classification module, the switching device determines if the received input audio signal contains speech signals based upon the output of the classification module.

9. The half duplex switching device of claim 8 wherein the classification module comprises:

a voice activity detector coupled to the input connection to provide an output indicating if the received input audio signal contains speech signals based upon energy levels of the input audio signal; and a parser device coupled to the input connection to provide an output indicating if the received input audio signal contains speech signals based upon the classification data provided with the input audio signal.

10. The half duplex switching device of claim 9 wherein the voice activity detector monitors a short-term moving average of the energy levels of the input audio signal, and a long-term moving average of the energy levels of the input audio signal.

11. The half duplex switching device of claim 10 wherein the voice activity detector also monitors a short-term minimum energy of the input audio signal.

12. The half duplex switching device of claim 9 wherein the voice activity detector monitors a short-term moving average of the energy levels of the input audio signal, and a short-term minimum energy level.

13. The half duplex switching device of claim 9 wherein the density measurement device maintains a histogram of the density of the received input audio signal over a predetermined time period.

14. The half duplex switching device of claim 13 wherein the density measurement device provides outputs indicating a signal density of the input audio signal, a standard deviation of the signal density, and an indication of an amount of time in which the input audio signal has a zero density.

15. A half duplex switching device comprising:

an input connection for receiving an input audio signal;

a density measurement device coupled to the input connection to provide an output indicating if the received input audio signal contains speech signals based upon a density of the input audio signal, wherein the density measurement device is further to sum an audio playback duration of the input audio signal into a bin in a histogram and shift all previous bins later in time with respect to a time of arrival of the input audio signal;

classification module coupled to the input connection, the classification module provides an output which indicates a classification of the input signal based upon a density percentage of the input signal and an energy level of the input signal; and a switching device coupled to the classification module, the switching device determines if the received input audio signal contains speech signals based upon the output of the classification module.

16. The half duplex switching device of claim 15 wherein the classification module comprises:

a voice activity detector coupled to the input connection to provide an output indicating if the received input audio signal contains speech signals based upon energy levels of the input audio signal.

17. A method of controlling a communication receiving circuit, the method comprising:

analyzing an input audio signal to determine a density of the input audio signal over a predetermined time period;

summing an audio playback duration of the input audio signal into a bin in a histogram;

shifting all previous bins later in time with respect to a time of arrival of the input audio signal;

analyzing the input audio signal to determine an energy level of the input audio signal;

analyzing any classification data provided with the input audio signal; and classifying the input audio signal based upon the determined density percentage, energy level, and any classification data provided.

18. The method of claim 17 wherein determining the density of the input audio signal comprises:

generating the histogram of the input audio signal over the predetermined time period; and calculating the density and standard deviation of the density using the histogram.

19. The method of claim 18 wherein determining the energy level further comprises:

determining a short-term energy level;

determining a short-term minimum energy level;

comparing the short-term energy level with the short-term minimum energy level.

20. The method of claim 17 wherein determining the energy level further comprises:

determining a short-term energy level;

determining a long-term energy level; and comparing the short-term energy level and the long-term energy level.

21. A computer readable medium comprising instructions to instruct a computer to perform the method comprising:

analyzing an input audio signal to determine a density percentage of the input audio signal over a predetermined time period;

summing an audio playback duration of the input audio signal into a bin in a histogram;

shifting all previous bins later in time with respect to a time of arrival of the input audio signal;

analyzing the input audio signal to determine an energy level of the input audio signal;

analyzing any classification data provided with the input audio signal; and classifying the input audio signal based upon the determined density percentage, energy level, and any classification data provided.

22. The computer readable medium of claim 21 wherein determining the density of the input audio signal of the method comprises:

generating the histogram of the input audio signal over the predetermined time period; and calculating the density and standard deviation of the density using the histogram.

23. The computer readable medium of claim 21 wherein determining the energy level of the method further comprises:

determining a short-term energy level;

determining a long-term energy level; and comparing the short-term energy level and the long-term energy level.

24. The computer readable medium of claim 21 wherein determining the energy level of the method further comprises:

determining a short-term energy level;

determining a short-term minimum energy level;

comparing the short-term energy level with the short-term minimum energy level.

* * * * *